US005907911A

United States Patent [19]

Huang

[11] Patent Number: 5,907,911

[45] Date of Patent: Jun. 1, 1999

[54] COMBINABLE SNEAKER WITH A REPLACEABLE MALE CUSHION

[76] Inventor: Ing Jing Huang, No. 218 Cheng Kong, 3rd Road, Nantou City, Taiwan

[21] Appl. No.: 08/874,453

[22] Filed: Jun. 16, 1997

[30] Foreign Application Priority Data

Jun. 15, 1996 [TW] Taiwan ..... 85107201

[51] Int. Cl.[6] ..... A43B 13/20; A43B 19/00

[52] U.S. Cl. ..... 36/29; 36/71

[58] Field of Search ..... 36/3 R, 3 B, 28, 36/29, 25 R, 71

[56] References Cited

U.S. PATENT DOCUMENTS

| | | | |
|---|---|---|---|
| 4,918,838 | 4/1990 | Chang | 36/29 X |
| 5,005,300 | 4/1991 | Diaz et al. | 36/28 X |
| 5,224,277 | 7/1993 | Sang Do | 36/27 |
| 5,313,717 | 5/1994 | Allen et al. | 36/29 X |
| 5,363,570 | 11/1994 | Allen et al. | 36/29 X |
| 5,685,090 | 11/1997 | Tawney et al. | 36/29 |

*Primary Examiner*—B. Dayoan

*Attorney, Agent, or Firm*—Jacobson, Price, Holman & Stern, PLLC

[57] ABSTRACT

A combinable sneaker with a replaceable male cushion has a sole provided with a female cushion formed integral with the sole. The female cushion has a plurality of chambers lengthwise and transverse, crossing each other to form corners. A male cushion is provided to releasably fit in the female cushion, having a plurality of projecting hollow cell bodies to fit in the chambers of the female cushion and then the male cushion is inflated to force the cell bodies to be expanded a little for firmly engaging the corners of the female cushion. The male cushion has a cross-section of three dimensional and hollow shape, with the projecting cell bodies sealed and a hollow tube connected to an air valve.

16 Claims, 5 Drawing Sheets

COMBINABLE SNEAKER WITH A REPLACEABLE MALE CUSHION

FIELD OF THE INVENTION

This invention concerns a sneaker combinable with a replaceable male cushion fitting releasably in a female cushion formed integral with a sole. The male cushion has a plurality of projecting hollow cell bodies to fit and be inflated in chambers of the female cushion so that the inflated cell bodies may engage firmly with the chambers or corners of the female cushion of the sole.

BACKGROUND OF THE INVENTION

Conventional sneakers with air cushions generally have a definitely shaped air cushion disposed in a heel of a sneaker. Some sneakers have an air cushion formed in a sneaker to provide an anti-shock effect. The air cushion cannot be too thick, so the height of the air filled in the cushion is also comparatively low, with the practical shock-absorbing effect being small. An air cushion disposed in a heel can have a larger space so that it has comparatively large shock-absorbing dimensions. However, an air cushion often breaks, so a sneaker has to be discarded owing to the broken air cushion, and to date no sneakers have a structure for replacing an air cushion with a new one, resulting in waste.

SUMMARY OF THE INVENTION

This invention has been created to offer a sneaker combinable with a replaceable male cushion to releasably fit in a female cushion formed integral with a sole of the sneaker.

A feature of the invention is that the male cushion is independently made, and has a plurality of projecting hollow cell bodies and is able to be inflated after the male cushion is inserted in the female cushion of the sole, so the male cushion may be secured in the female cushion, thereby giving the sneaker a good shock-absorbing function, and being replaceable in case of breakage.

BRIEF DESCRIPTION OF THE DRAWINGS

This invention will be better understood by referring to the accompanying drawings, wherein.

DETAILED DESCRIPTION OF THE PREFERRED EMBODIMENTS

Figure 1:
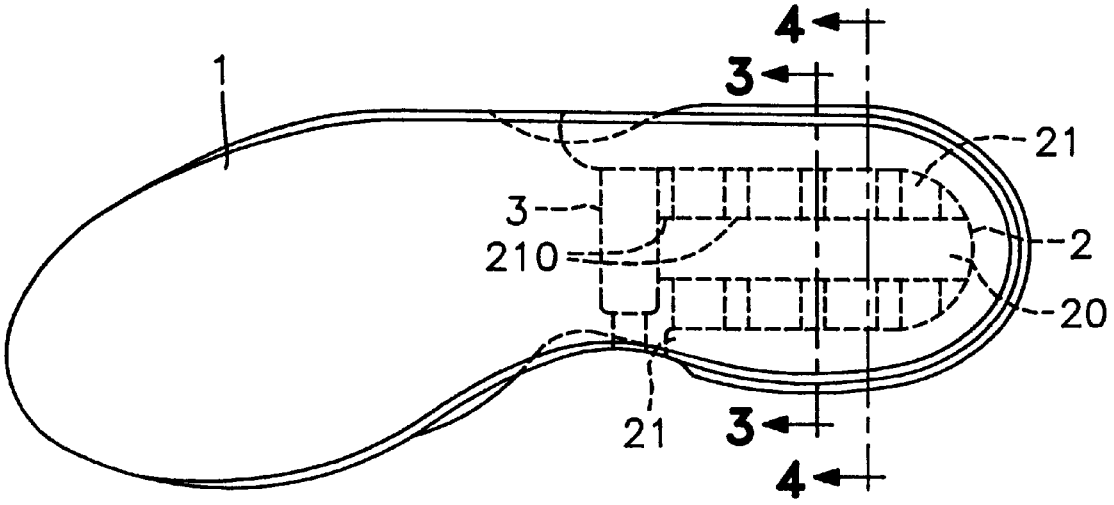
FIG. 1 is a top plan view of a sole with a first preferred embodiment of a female cushion of a combinable sneaker of the present invention.
Figure 2:
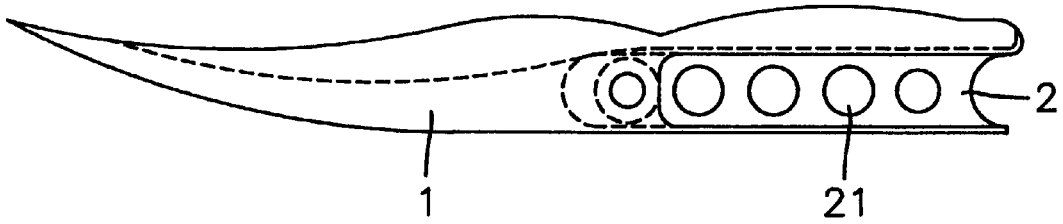
FIG. 2 is a side view of FIG. 1.
Figure 3:
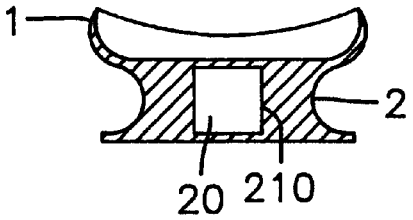
FIG. 3 is a cross-sectional view taken along line 3—3 in FIG. 1.
Figure 4:
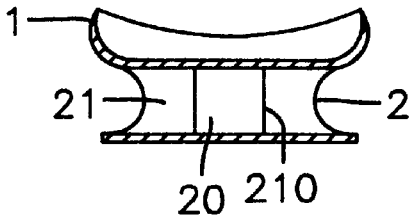
FIG. 4 is a cross-sectional view taken along line 4—4 in FIG. 1.
Figure 5:
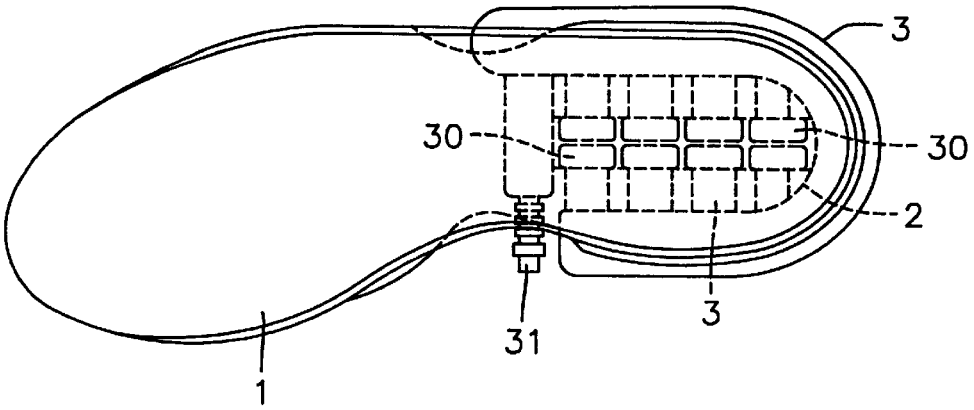
FIG. 5 is top plan view of the sole with the first preferred embodiment of a female cushion combined with a first preferred embodiment of a male cushion in of the present invention.
Figure 6:
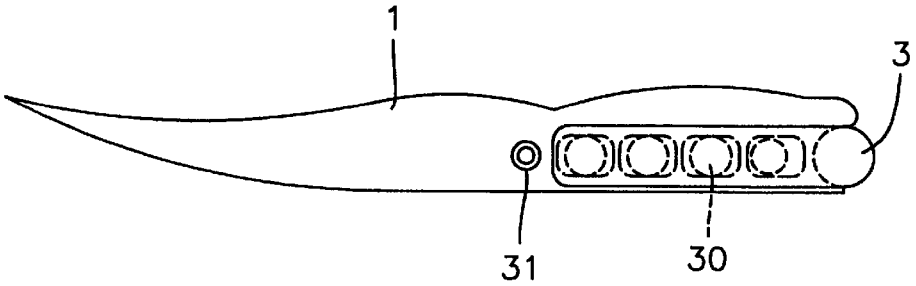
FIG. 6 is a side view of FIG. 5.

A combinable sneaker with a first preferred embodiment of a replaceable male cushion in the present invention, as shown in FIG. 1, includes a sole 1, a female cushion 2 formed integral in the sole 1, and a male cushion 3 fitting releasably in the female cushion 2.

A first preferred embodiment of the female cushion 2 formed integral in the sole 1 shown in FIGS. 1–4, has one or more elongate lengthwise hollow chambers 20 and one or more short transverse hollow chambers 21 in a heel portion which cross chamber 20, forming one or more corners 210. Each chamber 21 has a cross-section of any geometrical shape.

Figure 8:
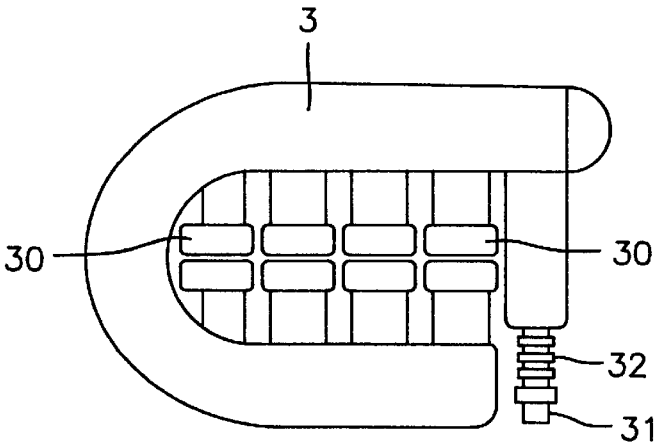
FIG. 8 is a top plan view of the first preferred embodiment of the male cushion of the present invention.
Figure 9:
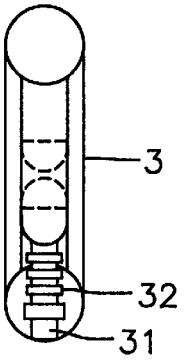
FIG. 9 is a right side view of FIG. 8.
Figure 7:
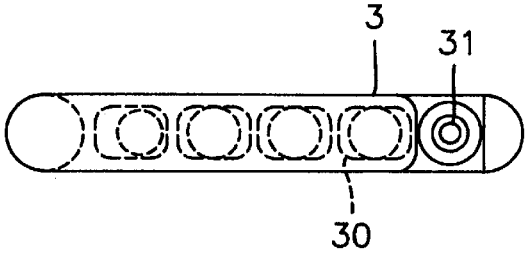
FIG. 7 is a side view of the first preferred embodiment of a male cushion of the present invention.

FIGS. 7, 8 and 9 show a first preferred embodiment of a male cushion 3, which has almost the same size as the female cushion 2, releasably fitting in the female cushion 2 and having the same number of projecting hollow cell bodies 30 as the short transverse hollow chambers 21 of the female cushion 2. When the male cushion 3 is in a deflated condition, it can be fitted into the female cushion 2, with the projecting cell bodies 30 fitting in the short transverse chambers 21 of the female cushion 2 and abutting at the corners 210. After the male cushion 3 is inserted in the female cushion 2 and inflated with a gas the projecting portions of the cell bodies 30 can be expanded a little to engage the corners 210 in an unreleasable condition so that the male cushion 3 may be firmly secured in the female cushion 2. Further, a hollow tube 32 with an air valve 31 is attached to the male cushion 3 for inflating it. Should the male cushion 3 become broken and deflated, it can be replaced with a new one.

Figure 10:
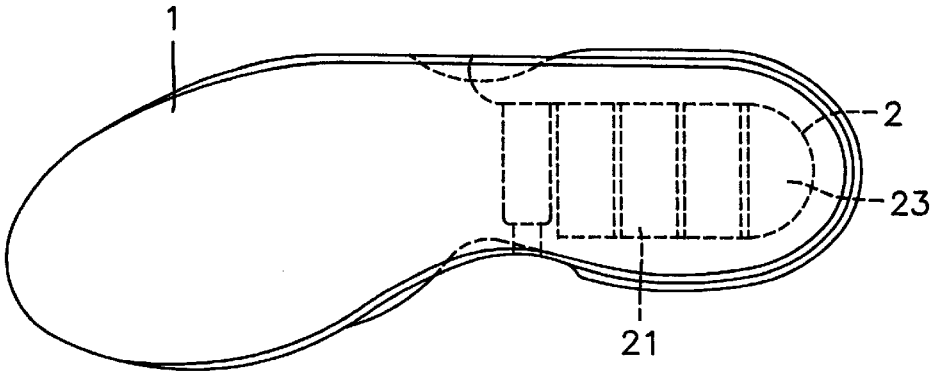
FIG. 10 is a top plan view of a second preferred embodiment of a female cushion of a sole of the present invention.
Figure 11:
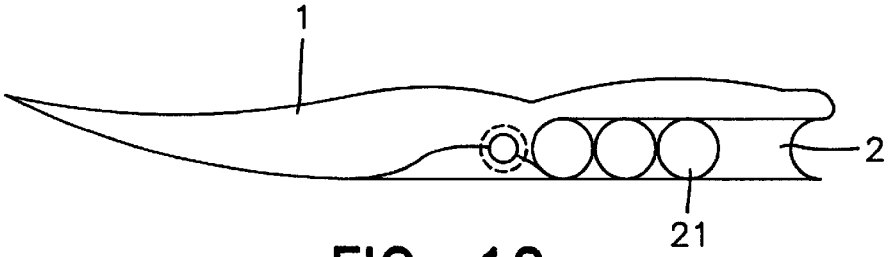
FIG. 11 is a side view of FIG. 10.
Figure 12:
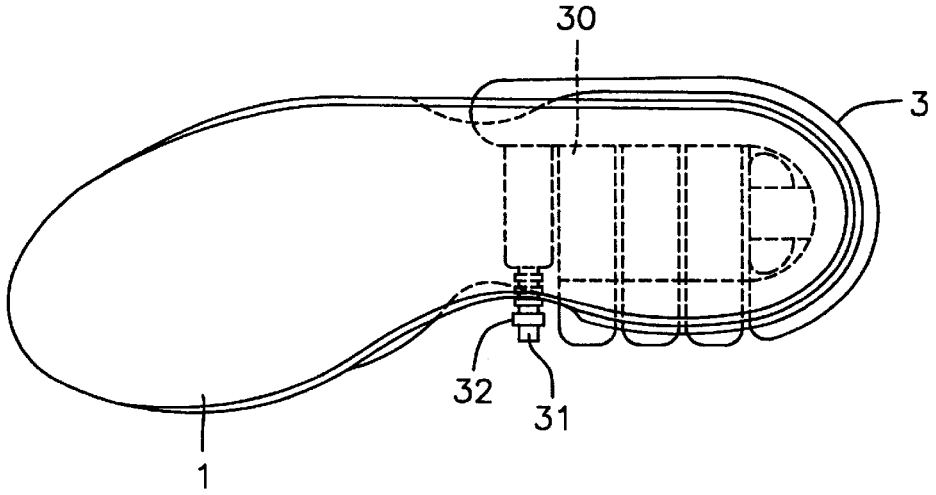
FIG. 12 is a top plan view of the second preferred embodiment of a female cushion of a sole combined with a second embodiment of a male cushion of the present invention.
Figure 13:
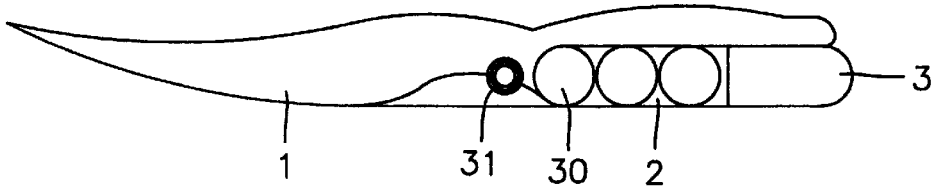
FIG. 13 is a side view of FIG. 12.
Figure 16:
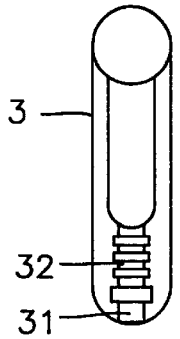
FIG. 16 is a side view of FIG. 15.
Figure 15:
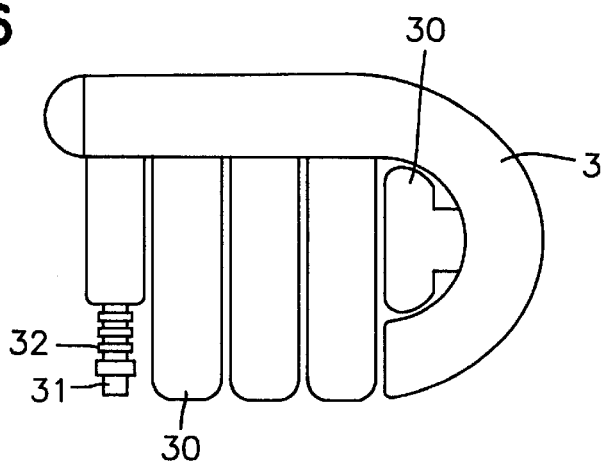
FIG. 15 is a top plan view of FIG. 14.
Figure 14:
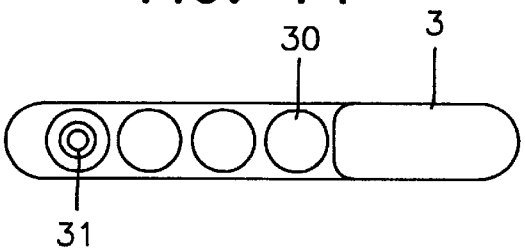
FIG. 14 is a side view of the second preferred embodiment of a male cushion of the present invention.

FIGS. 10 and 11 show a second preferred embodiment of a female cushion 2 of a sole of a combinable sneaker, provided with one or more transverse hollow chambers 21, and at least one transverse hollow chamber 23 is of an unequal inner diameter from the rest of the chambers 21 and it has a larger cross-section in the middle portion of the sneaker than cross-section toward the sides of the sneaker. Thus, the chamber 23 of unequal inner diameter engages a projecting cell body of unequal outer diameter of a male cushion 3. FIGS. 12, 13 show the second male cushion 3 combined with the second female cushion 2 of the sole 1. The second preferred embodiment of the male cushion 3 is shown in FIGS. 14, 15 and 16, having projecting hollow cell bodies 30, and one or more of the projecting cell bodies 30 do not have the same outer diameter as the rest of them so that after the second male cushion 3 is inserted in the second female cushion 2, it can be inflated to expand a little therein so as to be firmly secured therein.

Figure 17:
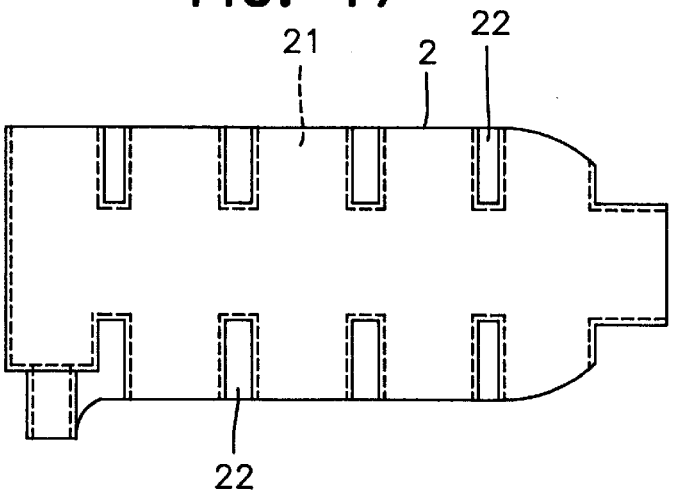
FIG. 17 is an elevational view of a third preferred embodiment of a female cushion independent from the sole of the present invention.
Figure 18:
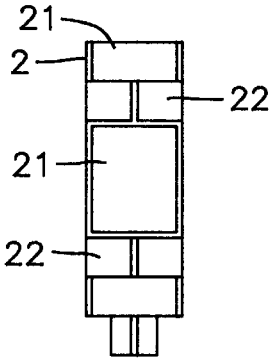
FIG. 18 is a right side view of FIG. 17.
Figure 19:
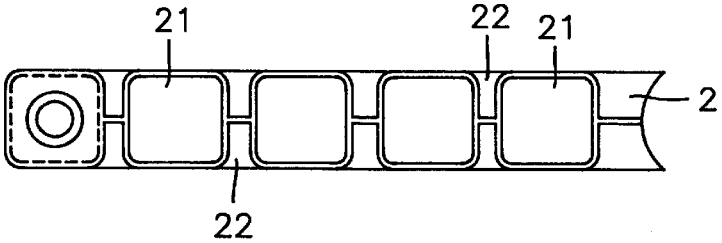
FIG. 19 is a side view of FIG. 17.
Figure 20:
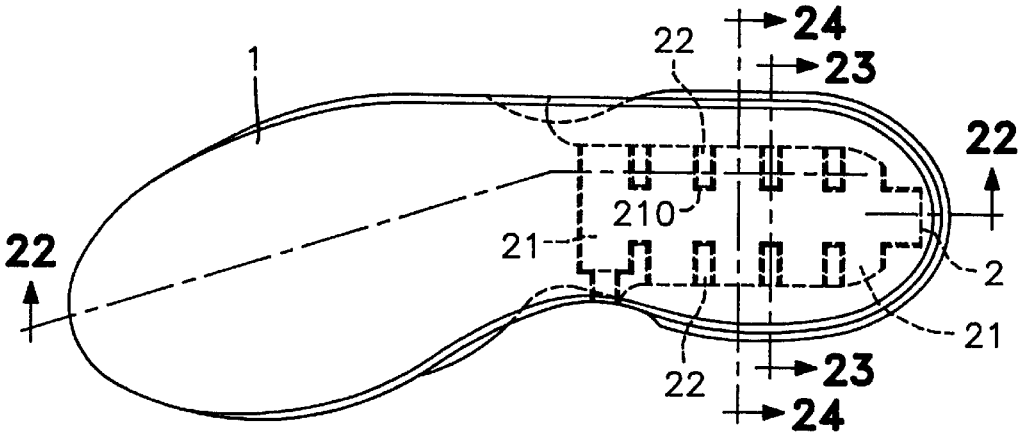
FIG. 20 is a top plan view of the sole with the third preferred embodiment of a female cushion combined with a third embodiment of a male cushion of the present invention.
Figure 21:
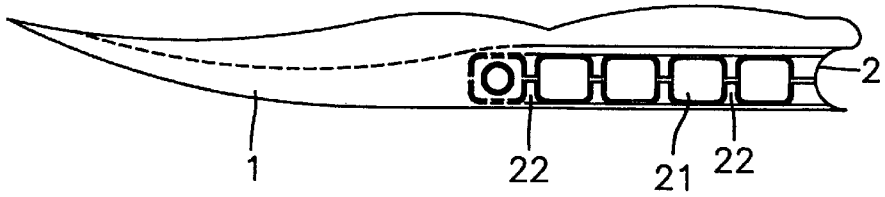
FIG. 21 is a side view of FIG. 20.
Figure 22:
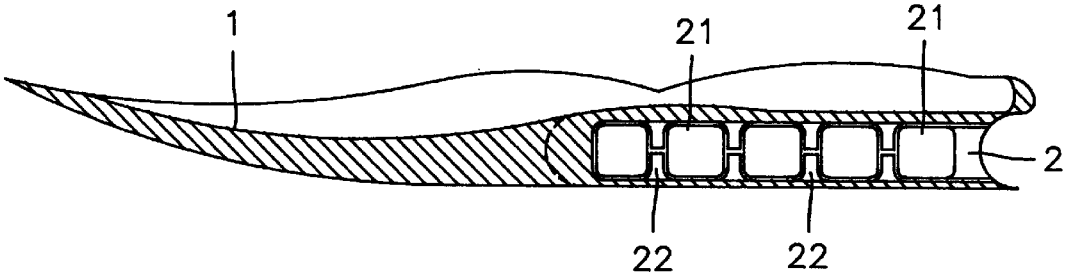
FIG. 22 is a magnified cross-sectional view taken along line 22—22 in FIG. 20.
Figure 24:
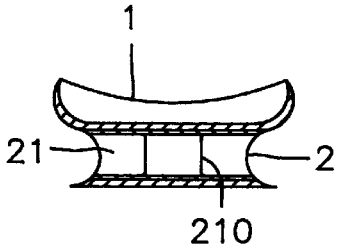
Figure 23:
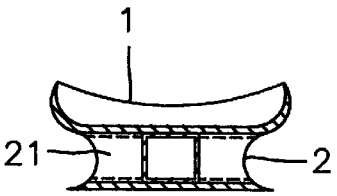
FIG. 23 is a magnified cross-sectional view taken along line 23—23 in FIG. 20; and, FIG. 24 is a magnified cross-sectional view taken along line 24—24 in FIG. 20.

A third preferred embodiment of a female cushion 2 is shown in FIGS. 17, 18 and 19, formed separate and independent from the sole 1 and releasably combinable with the sole 1. The third female cushion 2 has a plurality of hollow three dimensional chambers 21 equidistantly arranged on the two lengthwise opposite sides to accommodate the same number of projecting cell bodies 30 of a third male cushion 3 to fit therein. Further, the third female cushion 2 may be provided with recessed grooves or depressions 22 on an upper surface or a lower surface only, or on both of them, functioning as supporting ribs or posts after the male cushion 3 is fitted and inflated in the female cushion 2, prevented from disfiguring. The hollow three dimensional chambers 21 of the third female cushion 2 have at least one chamber having a different dimension from the rest of the chambers and, and one or more corners 210 are formed by a lengthwise chamber and one or more transverse chambers for the male cushion 3 to engage with.

The male cushion can be filled with a gas, a fluid, semi-fluid, a liquid or a low percolating large particle gas such as SF2, C2F6, etc.

The sneaker with a replaceable male cushion in the present invention has advantages as follows.

1. The male cushion can be replaced directly with a new one any time.

2. The projecting cell bodies of the male cushion having three-dimensional memory are easily inserted in the chambers of the female cushion in a deflated condition, and can easily be locked and secured after being inflated in the female cushions. The male cushion has a structure for easy assembly and replacement.

3. When the male cushion is punctured, it can be directly replaced with a new one, with the sneaker being continually usable, with its functionality not reduced.

4. The sneaker has a long service life because of the ability to replace the male cushions.

5. The sneaker has high industrial worth and profitability.

While the preferred embodiment of the invention has been described above, it will be recognized and understood that various modifications may be made therein and the appended claims are intended to cover all such modifications which may fall within the spirit and scope of the invention.

What is claimed is:

1. A combinable sneaker with a replaceable male cushion comprising a sole provided with a female cushion formed integral with said sole; said female cushion having at least one lengthwise hollow chamber, at least one transverse hollow chamber, and a plurality of corners formed by said lengthwise chamber and transverse chamber crossing with each other; a male cushion including a plurality of chambers and being releasably fitted in said female cushion and held in place by engagement with said plurality of corners of said female cushion;

said chambers of said female cushion and said male cushion each having a cross-section of a geometric shape, each being three dimensional and hollow;

at least one of said chambers of said male cushion being a different inner dimension from the rest of the chambers of the male cushion.

2. The combinable sneaker with a replaceable male cushion claimed in claim 1, wherein said male cushion can be inflated with a fluid selected from the group consisting of a gas, a liquid, and a low-percolating large particle gas.

3. A combinable sneaker with a replaceable male cushion comprising:

a sole provided with a female cushion formed integral with said sole, said female cushion having a plurality of three dimensional hollow chambers, at least one said hollow chamber being of different inner diameter from a remainder of the chambers;

a male cushion removably insertable in said female cushion, having at least one projecting hollow cell body to fit in said chamber of said female cushion and then to be inflated with a gas; and said chambers of said female cushion and said male cushion each having a cross-section of a geometric shape, each being three dimensional and hollow.

4. The combinable sneaker with a replaceable male cushion as claimed in claim 3, wherein said male cushion is provided with a plurality of grooves or depressions in at least one of the upper or lower surfaces.

5. The combinable sneaker with a replaceable male cushion as claimed in claim 3, wherein said male cushion is provided with a plurality of projecting hollow cell bodies to commensurately fit in said hollow chambers of said female cushion of said sole, at least one of said projecting hollow cell bodies having a different outer dimension from a remainder of said projecting hollow cell bodies.

6. A combinable sneaker with a replaceable male cushion comprising:

a sole with a hollow space for releasably fitting a female cushion therein;

said female cushion having at least two three dimensional hollow chambers, said chambers having at least one corner defined by at least one elongate lengthwise chamber and at least one short transverse chamber, at least one said short transverse chamber having a different inner dimension than the other chamber;

a male cushion releasably insertable in said female cushion and having a plurality of projecting hollow cells in a deflated condition to be inserted in said short transverse chambers of said female cushion, said projecting hollow cells swelling a little to engage said corners of said female cushion after said male cushion is inflated, at least one of said projecting hollow cells having different outer dimensions from a remainder of said projecting hollow cells; and said chambers of said female cushion and said male cushion cells having a cross-section of a geometric shape and being three dimensional and hollow.

7. The combinable sneaker with a replaceable male cushion as claimed in claim 6, wherein said male cushion is provided with a hollow tube connected with an air valve to inflate the projecting hollow cells.

8. The combinable sneaker with a replaceable male cushion as claimed in claim 6, wherein said male cushion is provided with a plurality of branched-out hollow cells, and at least a rear end of one cell having a larger cross-section in the middle axis of the sneaker than towards the sides of the sneaker.

9. A combinable sneaker with a replaceable male cushion comprising a sole provided with a female cushion formed integral with said sole;

said female cushion having at least one lengthwise hollow chamber, at least one transverse hollow chamber, and a plurality of corners formed by said lengthwise chamber and transverse chamber crossing with each other;

male cushion releasably fitted in said female cushion and including a plurality of chambers;

said chambers of said female cushion and said male cushion each having a cross-section of a geometric shape, each being three dimensional and hollow;

at least one of said chambers of said male cushion having a different inner dimension from a remainder of the chambers of the male cushion.

10. The combinable sneaker with a replaceable male cushion as claimed in claim 9, wherein said male cushion can be inflated with a fluid selected from the group consisting of a gas, a liquid, and a low-percolating large particle gas.

11. A combinable sneaker with a replaceable male cushion comprising:

a sole provided with a female cushion formed integral with said sole, said female cushion having a plurality of three dimensional hollow chambers, and at least a cavity formed along a side wall of said sole;

a male cushion removably insertable in said female cushion, having at least one projecting hollow cell body defining at least one chamber therein to fit in said chamber of said female cushion and then to be inflated with a gas; and said chambers of said female cushion and said male cushion each having a cross-section of a geometric shape, each being three dimensional and hollow;

said male cushion being provided with a plurality of grooves or depressions in at least one of the upper or lower surfaces thereof.

12. A combinable sneaker with a replaceable male cushion comprising:

a sole with a hollow space for releasably fitting a female cushion therein; said female cushion having at least two three dimensional hollow chambers, said chambers having at least one corner defined by at least one elongate lengthwise chamber and at least one short transverse chamber, said at least one short transverse chamber having a different inner dimension than the other chambers.

13. A combinable sneaker as claimed in claim 12, further comprising a male cushion releasably inserted in said female cushion and having a plurality of projecting hollow cells in a deflated condition to be inserted in said short transverse chambers of said female cushion, said projecting hollow cells swelling to engage said corners of said female cushion after said male cushion is inflated, at least one of said projecting hollow cells having different outer dimensions from a remainder of said projecting hollow cells; and said chambers of said female cushion and said male cushion cells having a cross-section of a geometric shape and being three dimensional and hollow.

14. The combinable sneaker with a replaceable male cushion as claimed in claim 13, wherein said male cushion is provided with a hollow tube connected with an air valve to inflate the projecting hollow cells.

15. The combinable sneaker with a replaceable male cushion as claimed in claim 13, wherein said male cushion is provided with a plurality of branched-out hollow cells, and at least a rear end of one cell having a larger cross-section in a middle axis of the sneaker than towards sides of the sneaker.

16. A combinable sneaker with a replaceable male cushion comprising:

a sole provided with a female cushion formed integral with said sole, said female cushion having a plurality of three dimensional hollow chambers, and at least a cavity formed along a side wall of said sole;

a male cushion removably insertable in said female cushion, having at least one projecting hollow cell body to fit in said chamber of said female cushion and then to be inflated with a gas; and said chambers of said female cushion and said male cushion each having a cross-section of a geometric shape, each being three dimensional and hollow;

said male cushion being provided with a plurality of projecting hollow cell bodies to commensurately fit in said hollow chambers of said female cushion of said sole, at least one of said projecting hollow cell bodies having a different outer dimension from a remainder of said male cushion projecting hollow cell bodies.

* * * * *